US008008983B2

(12) United States Patent
Ko et al.

(10) Patent No.: US 8,008,983 B2
(45) Date of Patent: Aug. 30, 2011

(54) WAVEGUIDE MULTIPLEXER AND WAVEGUIDE PHASE SHIFTER CONNECTED BY A POLARIZATION ADJUSTMENT ASSEMBLY

(75) Inventors: Tung Yi Ko, Hsinchu (TW); Chih Jung Lin, Hsinchu (TW)

(73) Assignee: Microelectronics Technology Inc., Hsinchu (TW)

( * ) Notice: Subject to any disclaimer, the term of this patent is extended or adjusted under 35 U.S.C. 154(b) by 220 days.

(21) Appl. No.: 12/351,203

(22) Filed: Jan. 9, 2009

(65) Prior Publication Data

US 2010/0039186 A1 Feb. 18, 2010

(30) Foreign Application Priority Data

Aug. 13, 2008 (TW) ..... 97214453 U

(51) Int. Cl.
*H01P 1/161* (2006.01)
*H01P 1/02* (2006.01)

(52) U.S. Cl. ..... 333/21 A; 333/135; 333/157; 333/254

(58) Field of Classification Search ..... 333/239, 333/248, 254, 157, 135, 21 A
See application file for complete search history.

(56) References Cited

U.S. PATENT DOCUMENTS

| | | | | |
|---|---|---|---|---|
| 6,229,407 | B1 * | 5/2001 | Follet et al. | 333/21 A |
| 7,420,443 | B2 * | 9/2008 | Paynter | 333/254 |
| 2007/0252665 | A1 * | 11/2007 | Voss et al. | 333/254 |
| 2008/0303613 | A1 * | 12/2008 | Lau et al. | 333/254 |

* cited by examiner

*Primary Examiner* — Benny Lee
(74) *Attorney, Agent, or Firm* — WPAT, P.C.; Anthony King

(57) ABSTRACT

An adjustable assembly apparatus includes a waveguide phase shifter and a waveguide multiplexer. The waveguide phase shifter has a first flange structure and the waveguide multiplexer has a second flange structure. The second flange structure and the first flange structure are embedded, and the polarization directions of the waveguide phase shifter and the waveguide multiplexer are orthogonal. In an embodiment, the first flange structure includes a bulge, the second flange structure includes a recess, and the bulge is embedded in the recess. The polarization directions of the bulge of the waveguide phase shifter and the recess of the waveguide multiplexer differ by 90 degrees.

6 Claims, 7 Drawing Sheets

WAVEGUIDE MULTIPLEXER AND WAVEGUIDE PHASE SHIFTER CONNECTED BY A POLARIZATION ADJUSTMENT ASSEMBLY

BACKGROUND OF THE INVENTION (A) Field of the Invention

The present invention is related to an adjustable assembly apparatus of a waveguide phase shifter and a waveguide multiplexer, and more specifically, to an adjustable assembly apparatus of a waveguide phase shifter and a waveguide multiplexer for satellite antenna signal transmission.

(B) Description of Related Art

For an ordinary satellite antenna communication system, the front end of the ground station uses the filter of a waveguide to separate the transmission signals and the receiving signals. Because the waveguide can reduce insertion loss for both transmission and receiving signals, optimal radiation power and receiving noise figure can be obtained.

FIG. 1 shows a known waveguide apparatus 10 for satellite antenna signal transmission. The waveguide apparatus 10 includes a waveguide phase shifter 120 and a waveguide multiplexer 130. The waveguide phase shifter 120 and the waveguide multiplexer 130 are connected by a clamp 180. The clamp 180 consists of two clamp parts 181 and 182 that can be separated or combined by inserting screws into screw holes 183. The waveguide phase shifter 120 consists of a first phase shifter member 122 and a second phase shifter member 124 that can be separated.

The electric field of electromagnetic radiation varies between rotating or linear orientation, in which the corresponding electromagnetic waves include circular polarized wave and linearly polarized wave. The circular polarized wave includes orthogonal left-hand and right-hand circular polarized waves, whereas the linearly polarized wave includes orthogonal horizontal and vertical polarizations. The use of orthogonal horizontal and vertical polarizations or left-hand and right-hand circular polarized waves at a same frequency is the so-called cross polarization spectrum reuse. The communication satellite using cross polarization spectrum reuse can benefit from doubled efficiency in use of spectrum resources.

However, the combination of the waveguide phase shifter 120 and the waveguide multiplexer 130 does not provide an oriented positioning mechanism; therefore the combination cannot ensure the two members are in orthogonal polarizations. As a result, the signal transmission efficiency and quality are not optimized.

SUMMARY OF THE INVENTION

The present invention provides an adjustable assembly apparatus of a waveguide phase shifter and a waveguide multiplexer for satellite antenna signal transmission. By using an embedded structure, the polarization directions of the waveguide phase shifter and the waveguide multiplexer are orthogonal so as to ensure the efficiency and the quality of signal transmission. The adjustable assembly apparatus of the present invention not only provides an orthogonal assembly mechanism but also ensures assembly accuracy to acquire the vertical/horizontal or left-hand/right-hand circular polarization signals.

According to the present invention, an adjustable assembly apparatus includes a waveguide phase shifter and a waveguide multiplexer. The waveguide phase shifter has a first flange structure and the waveguide multiplexer has a second flange structure. The second flange structure and the first flange structure are embedded, and the polarization directions of the waveguide phase shifter and the waveguide multiplexer are orthogonal.

In an embodiment, the first flange structure includes a bulge, the second flange structure includes a recess, and the bulge is embedded in the recess. The bulge of the waveguide phase shifter and the recess of the waveguide multiplexer have polarization directions that differ by 90 degrees. The adjustable assembly apparatus of a waveguide phase shifter and a waveguide multiplexer includes a clamp for combining the first flange structure and the second flange structure. In addition, the clamp includes a positioning lump and the second flange structure includes a positioning notch corresponding to the positioning lump for alignment when assembling by the clamp.

DETAILED DESCRIPTION OF THE INVENTION

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Figure 1:
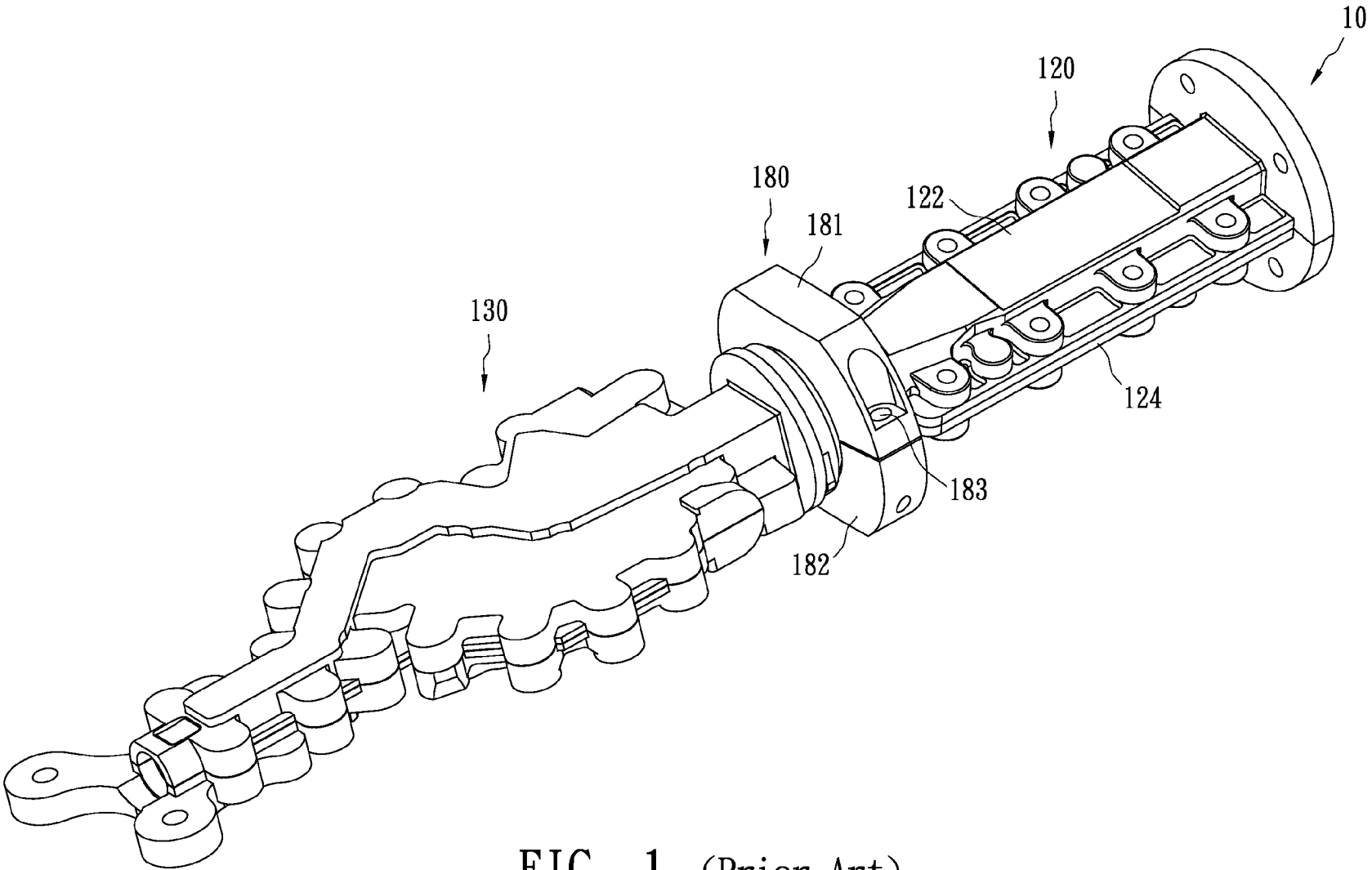
FIG. 1 (Prior Art)
FIG. 1 shows a known waveguide apparatus.
Figure 2:
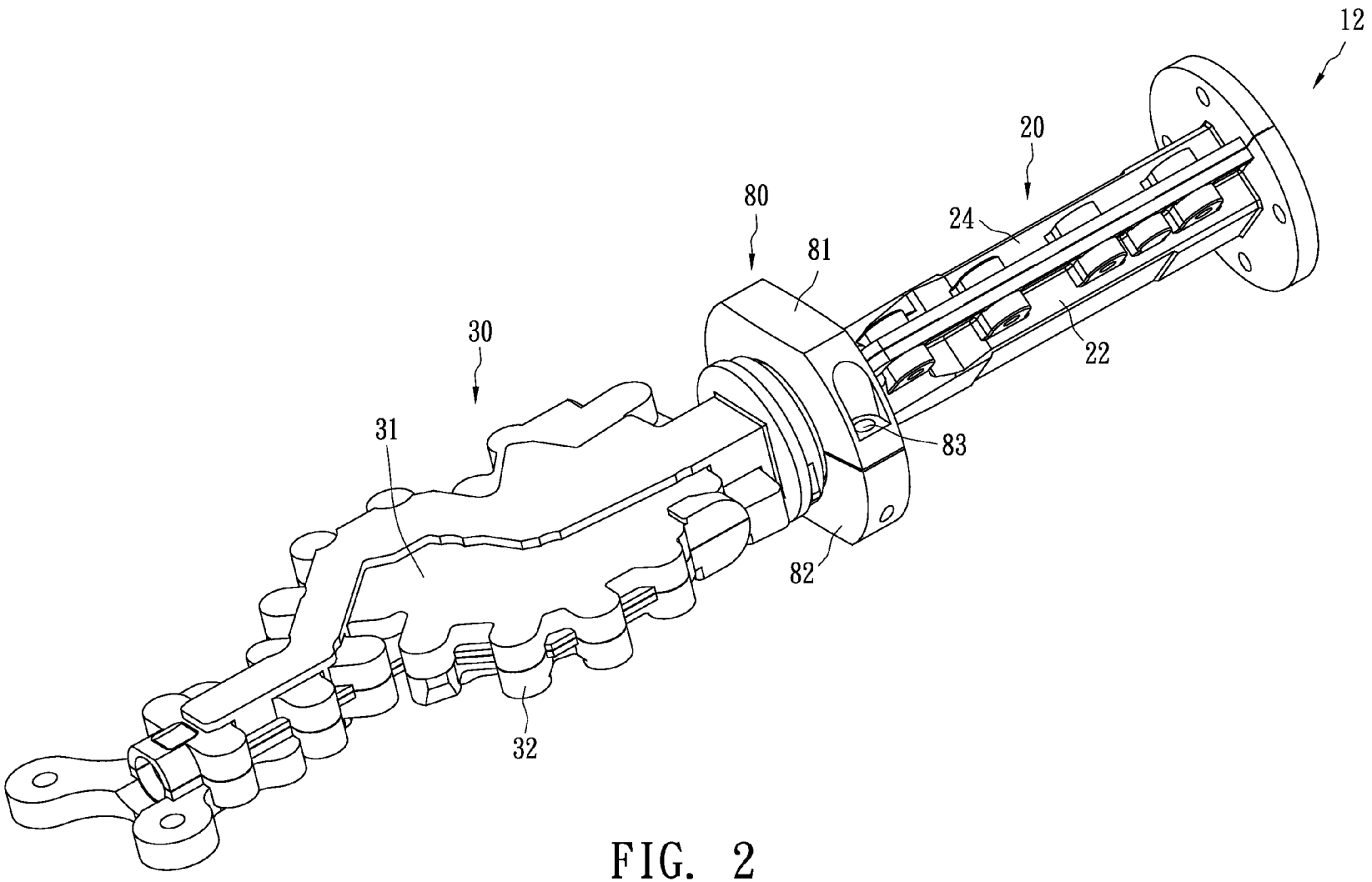
FIG. 2 shows an adjustable assembly apparatus of a waveguide phase shifter and a waveguide multiplexer in accordance with the present invention.

FIG. 2 shows an adjustable assembly apparatus 12 of a waveguide phase shifter and a waveguide multiplexer for a satellite antenna communication system. The combination 12 includes a waveguide phase shifter 20 and a waveguide multiplexer 30. The waveguide phase shifter 20 and the waveguide multiplexer 30 are combined by a clamp 80. The clamp 80 consists of clamp parts 81 and 82 that can be separated and combined by inserting screws into screw holes 83. The waveguide phase shifter 20 consists of a first phase shifter member 22 and a second phase shifter member 24 that can be separated. The waveguide multiplexer 30 consists of a first multiplexer member 31 and a second multiplexer member 32.

Figure 3A:
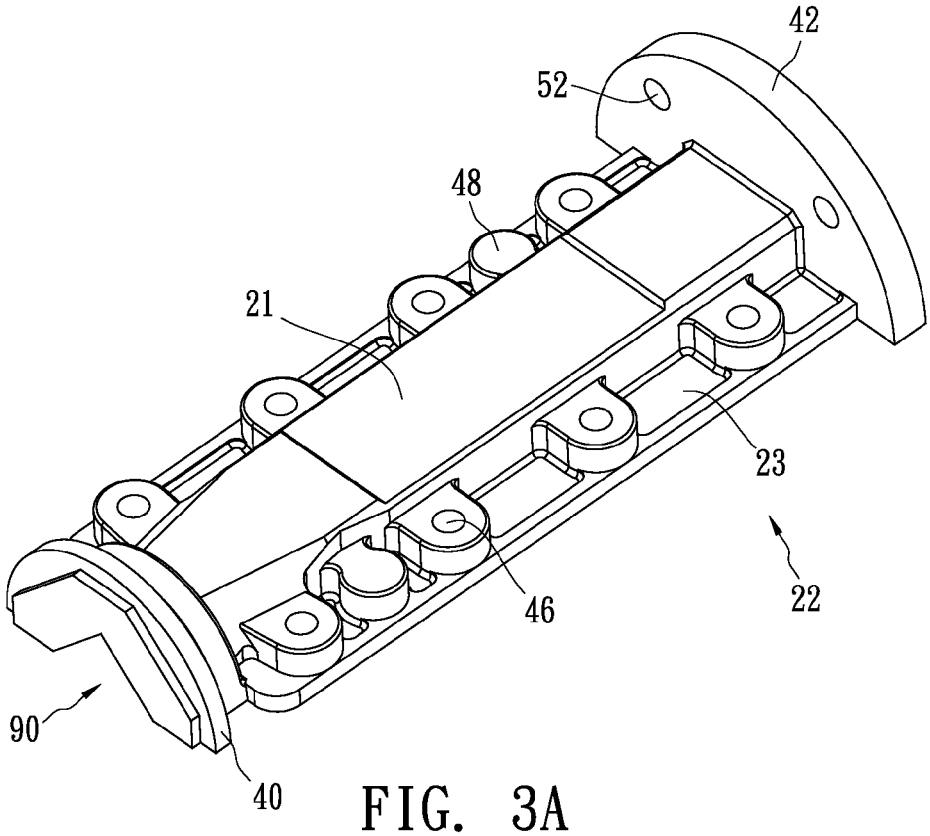
FIGS. 3A to 3C show a waveguide phase shifter in accordance with an embodiment of the present invention.

FIG. 3A shows the first phase shifter member 22. The first phase shifter member 22 includes a shell 21, two wing portions 23, a flange 40 and a flange 42. A groove is formed in the inner surface of the shell 21, and the two wing portions 23 are connected to two sides of the shell 21 and extend outwards. The flange 40 is connected to an end of the shell 21, whereas the flange 42 is connected to another end of the shell 21. The flange 40 has a polarization design to ensure the combination 12 being in orthogonal polarizations, and the flange 42 includes screw holes 52. A plurality of screw holes 46 are substantially placed on the wing portions 23 with equal spans for combining the first phase shifter member 22 and the second phase shifter member 24. The wing portions 23 further include positioning holes 48 for the alignment of the first phase shifter member 22 and the second phase shifter member 24 when assembling the first phase shifter member 22 and the second phase shifter member 24.

Figure 3B:
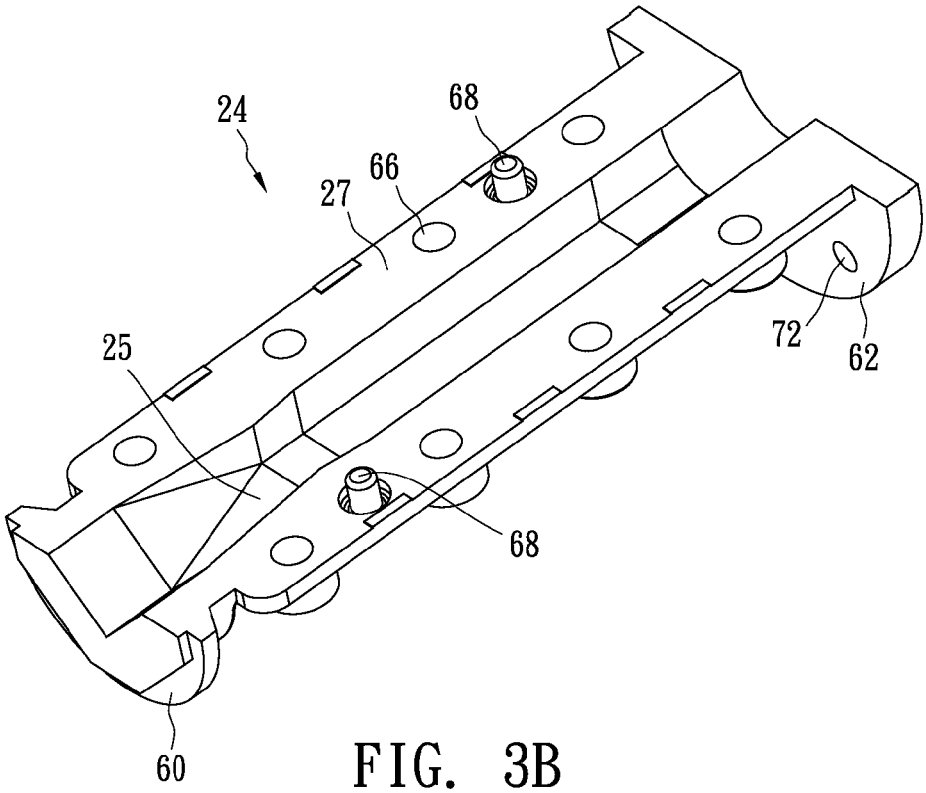

FIG. 3B shows the second phase shifter member 24. The second phase shifter member 24 includes a shell 25, two wing portions 27, a flange 60 and a flange 62. A groove is formed in the inner surface of the shell 25, and the two wing portions 27 are connected to two sides of the shell 25 and extend outwards. The flange 60 is connected to an end of the shell 25, whereas the flange 62 is connected to another end of the shell 25. The flange 60 has a polarization design to ensure the combination 12 being in orthogonal polarizations, and the flange 62 includes screw holes 72. A plurality of screw holes 66 are substantially placed on the wing portions 27 with equal spans, which correspond to the screw holes 46 of the first phase shifter member 22, for combining the first phase shifter member 22 and the second phase shifter member 24. The wing portions 27 further include positioning pins 68 that correspond to the positioning holes 48 of the first phase shifter member 22 for the alignment of the first phase shifter member 22 and the second phase shifter member 24 while assembling.

Figure 3C:
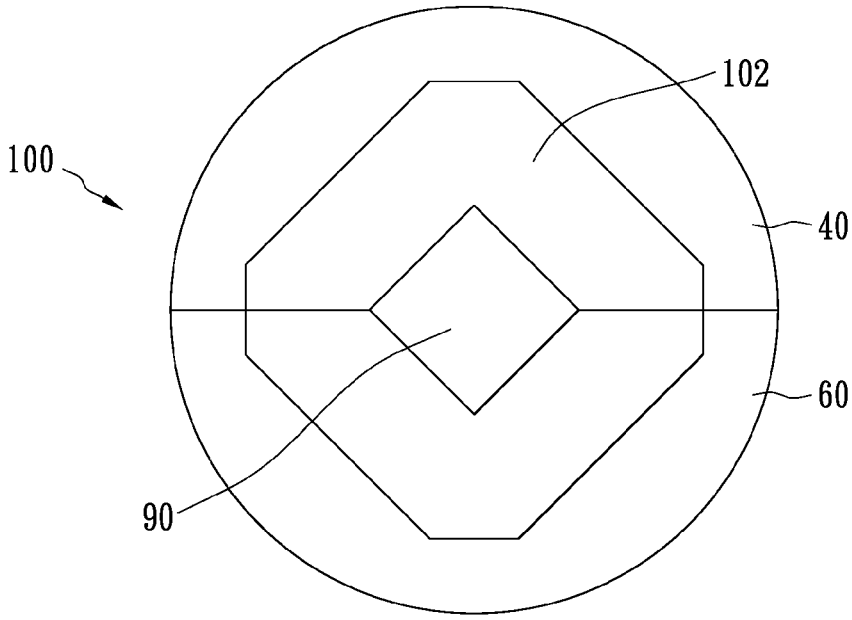

After the first phase shifter member 22 and the second phase shifter member 24 are combined, a through hole 90 is formed, as shown in FIG. 3C and FIG. 3A. FIG. 3C illustrates the left end of the combination of the phase shifter members 22 and 24 shown in FIGS. 3A and 3B. The flange 40 and the flange 60 form a hollow round flange structure 100 in which the hollow portion is square. The flange structure 100 includes an octagonal bulge 102 for polarization design to ensure the combination 12 being in orthogonal polarizations. The bulge 102 surrounds the square through hole 90.

Figure 4A:
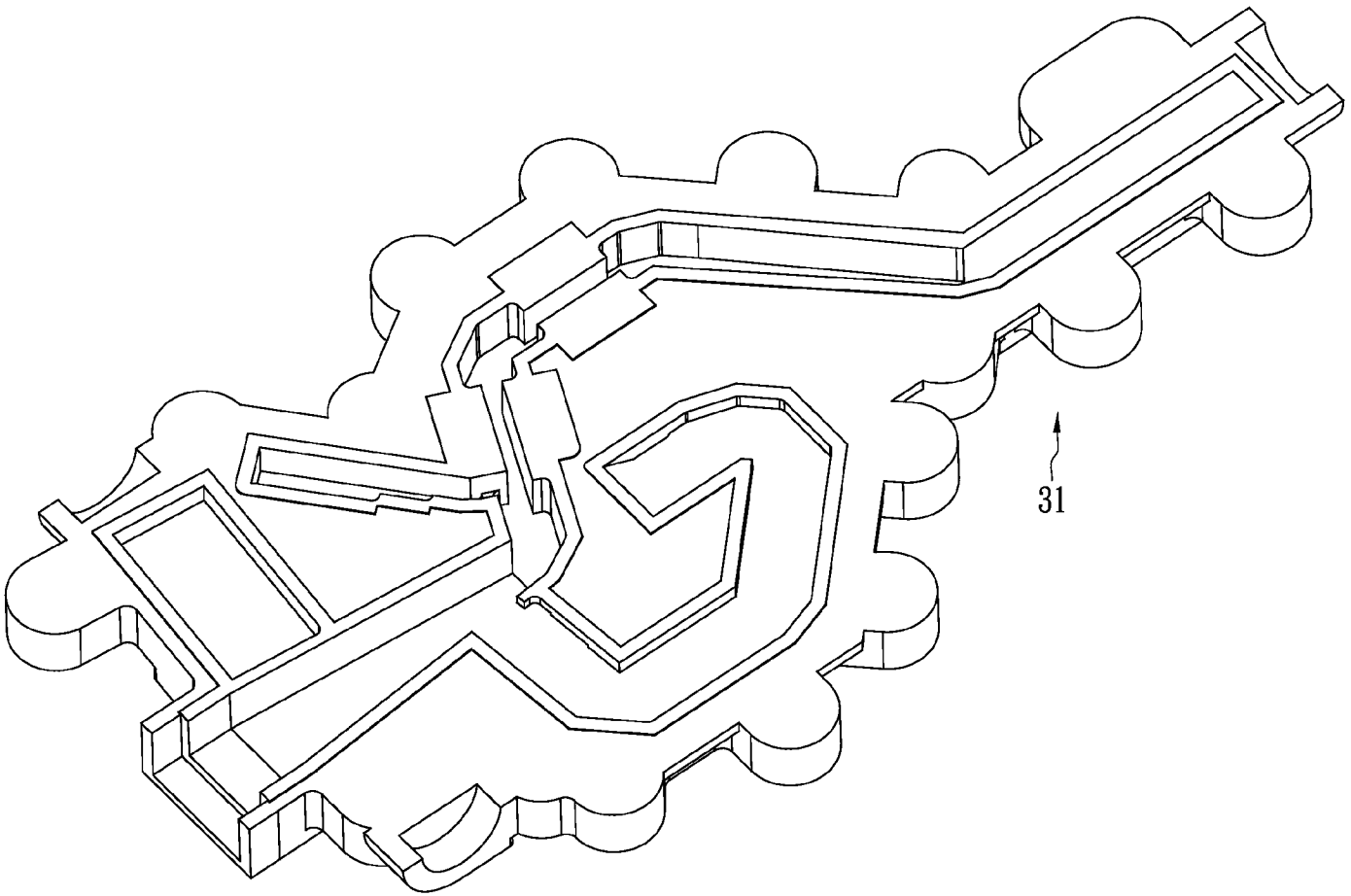
FIGS. 4A to 4C show a waveguide multiplexer in accordance with an embodiment of the present invention.
Figure 4B:
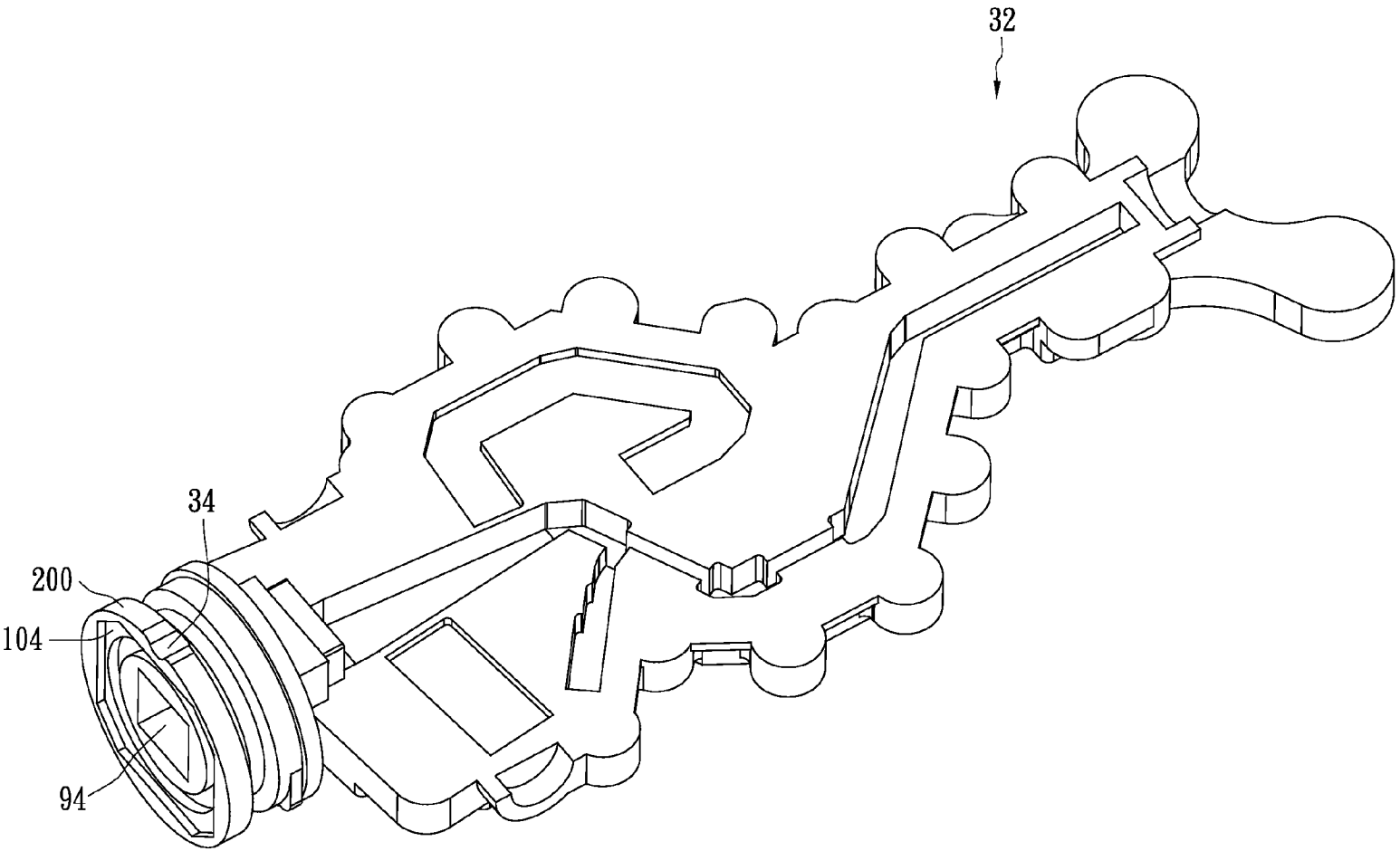
Figure 4C:
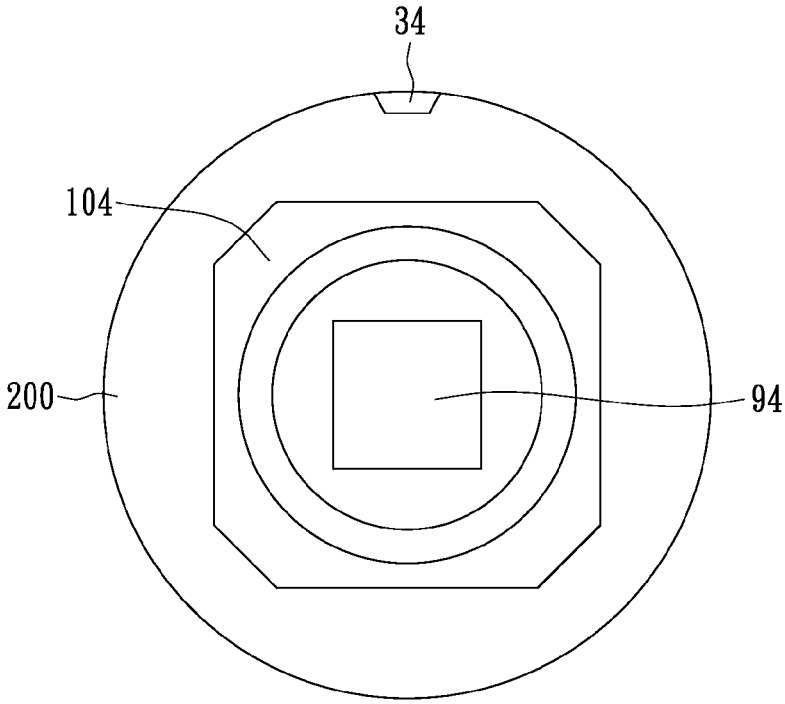

The waveguide multiplexer 30 includes a first multiplexer member 31 and a second multiplexer member 32 as shown in FIG. 4A and 4B, respectively. As shown in FIG. 4C, the second multiplexer member 32 includes a flange structure 200. The front view of the flange structure 200 is shown in FIG. 4C. The outer rim of the flange structure 200 is provided with a positioning notch 34, and a recess 104 is formed in the flange structure 200. The recess 104 (FIG. 4C) corresponds to the bulge 102 (FIG. 3C). In FIG. 4C, the second multiplexer member 32 (FIG. 4B) has an opening 94 corresponding to the through hole 90 (FIG. 3C). As shown in FIG. 2A, the opening 94 is aligned with the through hole 90 when the waveguide phase shifter 20 and the waveguide multiplexer 30 are combined. Referring to FIGS. 3C and 4C, the bulge 102 (FIG. 3C) has to be rotated by 90 degrees to be embedded in the recess 104 because the orientation of the bulge 102 differs from that of the recess 104 by 90 degrees. Accordingly, after the waveguide phase shifter 20 and the waveguide multiplexer 30 are combined, their polarization directions are orthogonal, and the apparatus of the waveguide phase shifter 20 and the waveguide multiplexer 30 can be adjusted to left-hand or right-hand (vertical or horizontal) as desired.

Figure 5A:
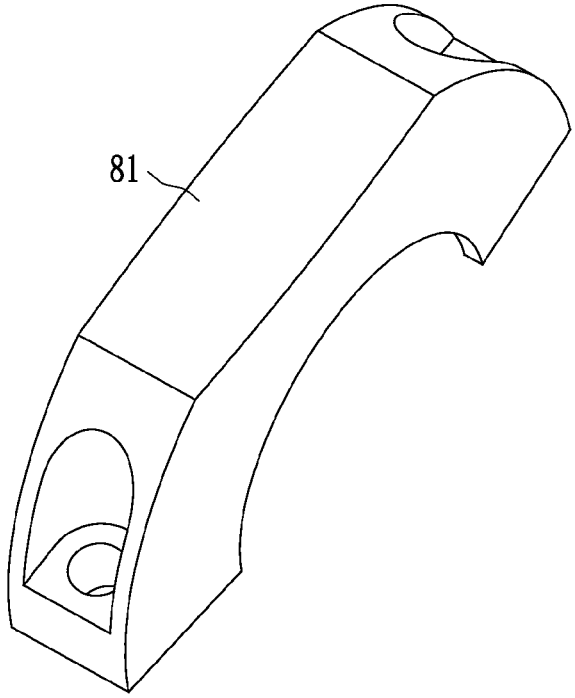
FIGS. 5A and 5B show a clamp in accordance with an embodiment of the present invention.
Figure 5B:
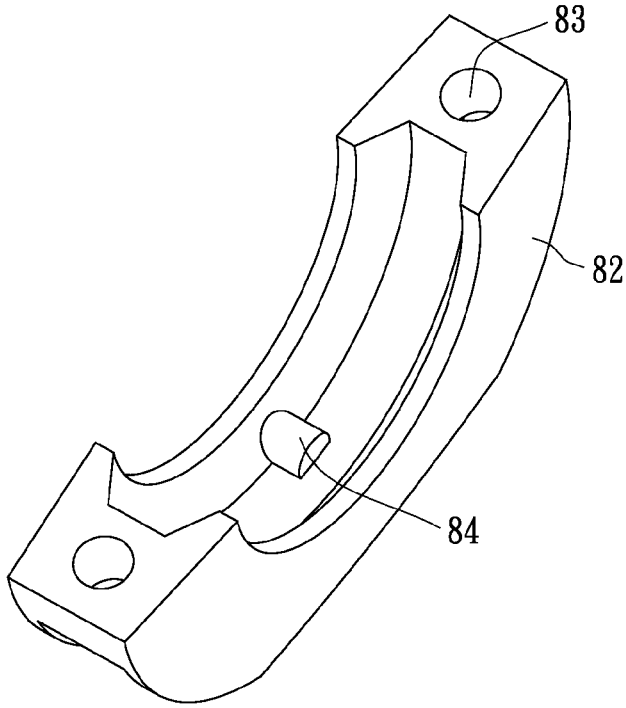

FIG. 5A and FIG. 5B show the clamp part 81 and the clamp part 82, respectively. The combination of the clamp part 81 and the clamp part 82 forms a hollow structure to enclose and combine the flange structures 100 (FIG. 3C) and 200 (FIG. 4C). The inner rim of the clamp part 82 includes a positioning lump 84 corresponding to the positioning notch 34 (FIG. 4C) of the flange structure 200 for alignment, thereby increasing the combination quality of the waveguide phase shifter 20 and the waveguide multiplexer 30.

The above-mentioned apparatus is merely an embodiment; various modifications can be made by people skilled in the art according to requirements. Nevertheless, such modifications are still covered by the claim scope of the present invention. For instance, the bulge could be formed in the waveguide multiplexer, and the recess could be formed in the waveguide phase shifter.

For the adjustable assembly apparatus of the waveguide phase shifter and waveguide multiplexer, there is no need to further adjust the combination angle to ensure that the polarization directions of the waveguide phase shifter and the waveguide multiplexer are orthogonal when combining the waveguide phase shifter and the waveguide multiplexer. Therefore, the assembly procedure is simplified and the signal transmission quality is increased.

The above-described embodiments of the present invention are intended to be illustrative only. Numerous alternative embodiments may be devised by those skilled in the art without departing from the scope of the following claims.

What is claimed is:

1. An adjustable assembly apparatus, comprising:

a waveguide phase shifter comprising a first flange structure having a polygon-shaped bulge;

a waveguide multiplexer comprising a second flange structure having a polygon-shaped recess, wherein the bulge is embedded in the recess to mate the waveguide phase shifter with the waveguide multiplexer in one of at least two optionally relative positions; and a clamp for combining the first flange structure and the second flange structure, said clamp having a positioning lump, wherein the second flange structure comprises a positioning notch corresponding to the positioning lump;

wherein polarization directions of electromagnetic waves respectively transmitted in the waveguide phase shifter and the waveguide multiplexer are orthogonal.

2. The adjustable assembly apparatus of claim 1, wherein the waveguide phase shifter is an assembly of two phase shifter members.

3. The adjustable assembly apparatus of claim 1, wherein the polarization direction of the electromagnetic wave transmitted in the bulge of the waveguide phase shifter differs from the polarization direction of the electromagnetic wave transmitted in the recess of the waveguide multiplexer by 90 degrees.

4. The adjustable assembly apparatus of claim 1, wherein the clamp is an assembly of two clamp parts.

5. The adjustable assembly apparatus of claim 1, wherein the positioning notch is disposed on an outer rim of the second flange structure, and the positioning lump is disposed on an inner rim of the clamp.

6. The adjustable assembly apparatus of claim 1, wherein the clamp has a hollow structure to enclose the first flange structure and the second flange structure.

* * * * *